United States Patent [19]

Gipp

[11] Patent Number: 4,530,781

[45] Date of Patent: Jul. 23, 1985

[54] METASTABLE PRESPOTTING COMPOSITION

[75] Inventor: Mark M. Gipp, Racine, Wis.

[73] Assignee: S. C. Johnson & Son, Inc., Racine, Wis.

[21] Appl. No.: 541,202

[22] Filed: Oct. 12, 1983

[51] Int. Cl.[3] ..... C11D 1/40

[52] U.S. Cl. ..... 252/546; 252/153; 252/170; 252/171; 252/527; 252/DIG. 11; 252/DIG. 19; 252/143

[58] Field of Search ..... 252/525, 544, 546, 173, 252/174.21, DIG. 1, DIG. 11, DIG. 14, 527, 153, 170, 171, 143

[56] References Cited

U.S. PATENT DOCUMENTS

| | | | |
|---|---|---|---|
| 3,887,497 | 6/1975 | Ulvild | 252/527 |
| 3,956,198 | 5/1976 | Bauer | 252/DIG. 14 |
| 4,285,840 | 8/1981 | Fricker | 252/173 |
| 4,438,009 | 3/1984 | Brusky et al. | 252/173 |

*Primary Examiner*—Paul Lieberman
*Assistant Examiner*—Hoa Van Le

[57] ABSTRACT

A metastable laundry prespotting composition comprising a chelating agent, at least one surfactant, solvent and water.

20 Claims, No Drawings

METASTABLE PRESPOTTING COMPOSITION

BACKGROUND OF THE INVENTION

This invention relates to laundry prespotting compositions. More particularly this invention relates to metastable emulsion laundry prespotting compositions having excellent stain removal properties.

Current commercially available prespotting compositions fall into two categories, those based primarily upon water and those based primarily upon solvents. The aqueous based prespotting compositions are primarily non-aerosol formulations intended for use in trigger spray bottles or squeeze bottles. These aqueous based prespotting compositions have good stain removal characteristics against the so-called water-borne stains. These stains include grape juice, mustard, grass, chocolate, clay and similar stains.

The solvent based composition formulations typically have been packaged in aerosol form. These solvent-based compositions typically are more effective in removing oil-borne stains, such as cooking oil, fat, spaghetti sauce, sebum, grease, motor oil and the like. It is possible to formulate solvent-based prespotting compositions with reasonable water-borne stain remover. However it is desirable to use a composition which has good removal for both water-borne and oil-borne stains.

There have been attempts to replace the solvent with water in prespotter compositions for both aerosol and non-aerosol formulation types. One approach is described in U.S. patent application Ser. No. 293,049 filed Aug. 14, 1981, now U.S. Pat. No. 4,438,009. The composition described in this application are aqueous emulsions containing a salt, a nonionic surfactant, from 5 to 60% by weight of a solvent, and water. These compositions are described as having good stain removal properties but these compositions require that some solvent be present for the enhanced stain removal.

BRIEF DESCRIPTION OF THE INVENTION

It has been suprisingly found that a water containing prespotting composition has good oily stain removal under most conditions encountered in the home laundry. This composition comprises a chelating agent, a solvent, at least one nonionic surfactant, and water. These solvent-containing compositions typically form at least two-phase compositions which can be readily redispersed by shaking to provide a metastable composition. The compositions of the present invention are primarily useful as liquid prespotting compositions which are suitable to be dispersed from pump spray or squeeze bottles.

OBJECTS AND ADVANTAGES

It is therefore the primary object of the present invention to provide a liquid prespotting composition having superior cleaning properties for both oil and water-borne stains.

It is the further object of the present invention to provide a laundry prespotting composition which separates into at least two phases but forms a metastable composition upon shaking.

It is a still further object of the present invention to provide an emulsion prespotting composition, which in a combination and solvent system has cleaning properties equal to or better than nonaqueous solvent containing compositions.

Still further objects and advantages of the composition of the present invention will become more apparent from the following more detailed description thereof.

DETAILED DESCRIPTION OF THE INVENTION

The laundry prespotting compositions of the present invention comprise a metastable laundry prespotting composition having from 0.25 to 10% by weight of a chelating agent; from about 1 to 35% by weight of at least one nonionic surfactant, said surfactant having HLB such that the combined HLB of the surfactants is within the range of from 9 to 13; from about 5 to 60% by weight of a solvent and the balance of the composition comprising water wherein the composition has a pH within the range of from 4.5 to 12.2.

By the term "metastable" is meant a liquid composition which tends to separate into at least two phases but upon shaking forms a substantially uniform composition which remains substantially uniform for at least about 15 minutes.

This metastable condition is critical to the performance of the compositions of the present invention. If a similar formulation is prepared as a stable emulsion, the cleaning is substantially reduced. It is thought that the metastable condition allows both the oil and water phase to be in the exterior phase at the same time so that the appropriate cleaning agent can attack the stain efficiently.

The first component of the compositions to the present invention is a chelating agent. It is thought that the chelating agent functions in the composition to the present invention to assist in removal of certain heavy ions which inhibit the surfactancy of the nonionic surfactants. Also these chelating agents act in concert with the monionic surfactant so that the surfactant is in the right configuration to attack oily stains from an aqueous system. Suitable chelating agents include the salts of ethylenediamine tetraacetic acid (EDTA) such as ethylenediaminetetraacetic acid disodium salt, ethylenediaminetetraacetic acid diammonium salt, ethylenediaminetetraacetic acid trisodium salt, ethylenediaminetetraacetic acid tetrasodium salt, ethylenediaminetetraacetic acid tetrapotassium salt, ethylenediaminetetraacetic acid tetrammonium salt, etc., the salts of diethylenetriaminepentaacetic acid (DTPA) such as diethylenetriaminepentaacetic acid pentasodium salt, diethylenetriaminepentaacetic acid pentapotassium salt, etc., the salts of (N-hydroxyethyl)ethylenediaminetriacetic acid (HEDTA) such as (N-hydroxyethyl)ethylenediaminetriacetic acid trisodium salt, (N-hydroxyethyl)ethylenediaminetriacetic acid tripotassium salt, etc., the salts of nitrilotriacetic acid (NTA) such as nitrilotriacetic acid trisodium salt, nitrilotriacetic acid tripotassium salt, etc., other chelating agents such as triethanolamine, diethanolamine, monoethanolamine, etc. and mixtures thereof. Preferred chelating agents are the EDTA and the NTA type chelating agents especially the salts of ethylenediaminetretraacetic acid and particularly the tetrasodium, trisodium and disodium salts of ethylenediaminetetraacetic acid.

Typically the chelating agents are present in the composition of the present invention in an amount of from about 0.25 to 10% by weight. It is within this weight range that the optimum cleaning and prespotting efficiency is obtained. It is preferred that the chelating agents be present in the amount of from about 1.0 to 6% by weight and preferable from 1.5 to 4.0% by weight.

The chelating agents, especially the EDTA, DTPA, and HEDTA types, can be added to the composition of the present invention in the salt form, which is preferred since the salts are water soluble, or in the water insoluble free acid form. If the chelating agents are added in the free acid form, the free acids must be at least partially neutralized to make them water soluble and form the chelating agent salts in situ. Suitable bases to neutralize the free acids are sodium hydroxide, potassium hydroxide and ammonium hydroxide. Sufficient base is added to solubilize the free acid chelating agent and to bring the pH of the composition within the range of about 4.5 to 12.2.

If the chelating agents are added as salts, these salts are often quite basic, having a pH often above 10. It may be necessary to add some acid or other pH buffering material to the composition of the present invention to adjust the pH to within a range of from 4.5 to 12.2 and preferably 6.5 to 8.5 and most preferably 7 to 8. Suitable acids include citric acid, oxalic acid, acetic acid, hydrochloric acid, phosphoric, and the like. The primary function of the acid is to control the pH so that the chelating agent and the surfactants can remove the stains from the fabrics. Certain organic acids also have some chelating properties and therefore may contribute to the overall cleaning efficiency of the prespotting composition. Generally the acids, if used, are present in the compositions in the amount of from 0.2 to 2% by weight, however the amount of acid used is not critical. The preferred acid is citric acid.

The composition of the present invention also include at least one nonionic surfactant. A single nonionic surfactant having an appropriate HLB can be utilized or mixtures of nonionic surfactants such that the HLB of the resulting mixture of nonionic surfactants is within the appropriate range. It has generally been found that the nonionic surfactant or mixture of nonionic surfactants should have an HLB within the range of from 9 to 13 for optimum efficiency. It is preferred that HLB be between 10 and 12. The optimum HLB range is from 10.5 to 11.5.

Suitable nonionic surfactants include the ethoxylated nonyphenols such as the Surfonic N series available from Texaco Chemicals; and the ethoxylated octylphenols including the Triton X series available from Rohm & Haas; the ethoxylated secondary fatty alcohols such as the Tergitol series available from Union Carbide; the ethoxylated primary fatty alcohols such as the Neodols available from Shell Chemicals; the ethoxylated sorbitan fatty acid esters such as the Tweens from ICI America and the sorbitan fatty acid esters such as the Spans from ICI America.

The preferred surfactants include the ethoxylated nonylphenols especially those having a degree of ethyloxylation of from 3 to 10 moles of ethylene oxide, the ethoxylated octylphenols especially those having from 3 to 10 moles of ethyleneoxide and the ethoxylated secondary alcohols especially those having from 3 to 10 moles of ethyleneoxide. As noted above mixtures of nonionic surfactants, which individually have an HLB outside the range, can be utilized so long as the resultant HLB value of the mixture is within the range as set forth above. It is within this HLB range that the stain removal properties of the composition of the present invention are at a maximum. Outside this range there is not sufficient oil and water dispersibility to provide suitable stain removing properties. Generally it has been found that the nonionic surfactants which are water dispersible have the best stain removal properties in the compositions of the present invention. It is thought that water dispersible surfactants can act both against oil and water borne stains.

Generally the composition should include from 1 to 35% by weight of at least one nonionic surfactant and preferably from 5 to 20% by weight and optimally 7 to 20% by weight of at least one nonionic surfactant.

The composition of the present invention also can include from about 5 to 60% by weight of a suitable solvent. It is preferred that relatively small amounts of solvent be used. The preferred range is 5 to 30% by weight and the optimum range is 7 to 20% by weight of solvent.

Suitable solvents include hydrocarbon solvent such as isoparaffinic hydrocarbons including the mixed $C_{10}$ to $C_{12}$ isoparaffinic hydrocarbons sold under the trade name Isopar by Exxon Chemicals, Houston, Tex. These isoparaffinic hydrocarbons are branched chain fully saturated hydrocarbons and are often characterized by boiling range. These mixtures are available in boiling ranges of from 98° C. to 210° C. In addition to the isoparaffinic hydrocarbons, petroleum solvents having a boiling range of from 195° C. to 250° C., deodorized kerosene, mineral spirits, terpenes such as d-limonene and aromatic solvents such as xylene, etc. are also acceptable. In addition to these solvents certain chlorinated solvents such as 1,1,1-Trichloroethane, perchloroethylene and methylene chloride, certain ketones such as methylethyl ketone, etc., acetone, N-methyl-2-pyrrolidone, certain ethers such as dipropyleneglycol monomethyl ether, 1-butoxy propanol, etc. can also be utilized. Certain of these solvents may not be suitable for use in a home laundry. However the preferred solvents are those having a low odor, especially the isoparaffinic hydrocarbons, mineral spirits, deodorized kerosene and mixtures. Furthermore the most preferred isoparaffinic hydrocarbons are those having a boiling range of from 157° C. to 210° C. and preferably those having a boiling range of 177° C. to 202° C.

It is further preferred that only a small percentage, less than 5% by weight of the composition, of the solvent present, be solvents such as the terpenes, ketones, aromatics, ethers, and chlorinated hydrocarbons. Typically these solvents are used as adjuvants to boost the stain removal in combination with the isoparaffinic hydrocarbons, mineral spirits, deodorized kerosene, etc.

The compositions of the present invention can also include small additional amounts of other conventional materials including perfumes, defoamers, bacteriacides, bacterstats and the like. Generally these materials are present in amounts of less than 2% by weight based on the amount of the composition.

It is critical to the performance of the compositions of the present invention that the compositions be metastable. Although the compositions should separate into at least two phases on standing, the separation could occur over a period of as long as one or two days. As noted above, the compostions must be capable of remaining in their unseparated state for at least about 15 minutes. If the compositions separate at a faster rate, the usefulness of the compositions is lessened as the composition would have to be shaken continually.

The compostions of the present invention can be prepared by any conventional means. Suitable methods include cold blending or other mixing processes. It is not necessary to use high shear or other strenuous mixing techniques to prepare the compositions of the present invention.

The prespotting compositions of the present invention will now be illustrated by way of the following examples where all part percentages are by weight and all temperatures and degrees celeius unless otherwise indicated.

EXAMPLE A

An artificial sebum soil was prepared as follows:

| | Weight (Gms) |
|---|---|
| Part A | |
| Palmitic Acid | 5.0 |
| Stearic Acid | 2.5 |
| Coconut Oil | 7.5 |
| Paraffin | 5.0 |
| Spermaceti | 7.5 |
| Olive Oil | 10.0 |
| Squalene | 2.5 |
| Chloresterol | 2.5 |
| Oleic Acid | 5.0 |
| Linoleic Acid | 2.5 |
| | 50.0 |
| Part B | |
| Oleic Acid | 4.0 gms. |
| Triethanolamine | 8.0 gms. |

Melt all the components of Part A together at 120°-130° F. Add Part B to Part A with agitation while hot until homogeneous. At this time, 12 grams of air filter dirt (+200 mesh) is added and agitated for 10 minutes. From 50-100 ml of 120° F. deionized water is added with agitation and stirred for 10 minutes. From 900-950 ml (to total 1000 ml) of 120° F. deionized water is added and agitated until the temperature of the mixture drops to 110° F. The mixture is agitated in a Gifford Wood Homogenizer for 10 minutes or until 120° F. Pour the mixture through cheesecloth and store in 100° F. oven.

EXAMPLE B

Grass stain slurry is prepared by placing 50 grams of fresh grass clippings and 500 grams of water in a blender and gradually increasing the speed to "liquify". Add isopropyl alcohol as needed (up to 50 grams) to reduce foaming and blend for 20 minutes. Add remainder of isopropyl alcohol (to 50 grams total) and mix for 5 minutes. Strain through a 40 mesh screen and keep refrigerated until use.

EXAMPLE 1

The following formulation was prepared:

| | |
|---|---|
| Tetrasodium salt of ethylenediamine-tetraacetic acid (40%) | 5.0 |
| Citric Acid (50%) | 0.9 |
| Nonylphenol Ethoxylate (6 moles ethylene oxide) (Surfonic N-60) | 8.0 |
| Nonylphenol Ethoxylate (3.5 moles ethylene oxide) (Surfonic N-31.5) | 0.5 |
| Isoparaffinic hydrocarbon (boiling range 177° C. to 202° C.) (Isopar K) | 16.0 |
| d-limonene | 1.5 |
| Sorbitan monooleate (Span 80) | 0.9 |
| Sorbitan monooleate ethoxylate (20 moles ethylene oxide) (Tween 80) | 1.1 |
| Water | 66.1 |
| | 100.0 |

The above formulation was evaluated for stain removal by placing the composition in a squeeze bottle with a fountain type cap. The formulation was compared to a solvent based formulation sold by Clorox Corp. This commercially available product is believed to contain about 70% of an isoparaffinic hydrocarbon solvent similar to Isopar K and about 30% of a linear $C_{12}$ containing fatty alcohol ethoxylate having about 6.5 moles of ethylene oxide similar to Neodol 23-6.5 from Shell Oil. The formulations were tested on 3 types of white cloth swatches; 100% cotton, 65/35 polyester/-cotton, and 100% polyester. Each swatch was stained with 7 stains; used motor oil, mustard, grape juice, chocolate, a 20% clay slurry, artificial sebum (Example A), and grass slurry (Example B).

The swatches were saturated with the above formulation and allowed to sit for 1 minute. The swatches were then washed with Tide detergent, available from Procter & Gamble, with a dummy load of cotton towels. The stain removal characteristics were rated on a 5 point scale with 1 being essentially no removal and 5 being complete removal. The results are shown in Table 1.

TABLE 1

| | 100% Cotton | | 65 Polyester/ 35 Cotton | | 100% Polyester | |
|---|---|---|---|---|---|---|
| STAIN | Ex. 1 | Comp. | Ex. 1 | Comp. | Ex. 1 | Comp. |
| Used Oil | 4.5 | 4.5 | 4 | 4 | 3.5 | 3.5 |
| Mustard | 2 | 2 | 4 | 4 | 5 | 5 |
| Grape juice | 4 | 2 | 3.5 | 3 | 5 | 5 |
| Chocolate | 3 | 3 | 3 | 2.5 | 5 | 5 |
| Clay | 1 | 1 | 3.5 | 3 | 3.5 | 3.5 |
| Grass | 3 | 3 | 3 | 3 | 4 | 4 |
| Sebum | 3 | 3 | 4 | 4 | 5 | 5 |
| Composite | 20.5 | 18.5 | 25.0 | 23.5 | 31 | 31 |

From the above table it is apparent that the formula of Example 1 performs equivalent to the all solvent formula in most respects and somewhat better against a few stains.

EXAMPLE 2

The following formulation was prepared:

| | |
|---|---|
| Borax | 1.5% |
| Tetrasodium salt of ethylenediamine-tetraacetic acid (40%) | 5.0% |
| Citric Acid (50%) | 2.0% |
| Surfonic N60 | 8.0% |
| Surfonic N31-5 | 0.5% |
| Isopar-K | 8.0% |
| Water | 71.0% |
| Span 80 | 0.9% |
| Tween 80 | 1.1% |
| Xylene | 2.0% |

This formulation was tested as in Example 1 with similar results.

EXAMPLE 3

The formulation of Example 2 was prepared with the exception that the Xylene was replaced by the following:

| RUN | SOLVENT |
|---|---|
| A | Perchloroethylene |
| B | Methylethylketone |
| C | Dipropyleneglycol monomethyl ether |
| D | Acetone |

-continued

| RUN | SOLVENT |
|---|---|
| E | Methylene chloride |
| F | d-limonene |
| G | N—methyl-2-pyrrolidone |
| H | 1-Butoxypropanol |

Each of the above formulations when tested as in Example 1 performed in a similar manner.

EXAMPLE 4

The formulation of Example 1 was prepared with the exception that the Isopar-K level was 12% and the water level of 70.1%. This formulation when compared to that of Example 1 gave essentially similar results.

EXAMPLE 5

The formulation having the following composition was prepared:

| | |
|---|---|
| Tetrasodium salt of ethylenediamine-tetraacetic acid | 5.0 |
| Citric Acid (50%) | 0.9 |
| Surfonic N-60 | 8.0 |
| Surfonic N-31.5 | 0.5 |
| Isopar K | 12.0 |
| 1,1,1 Trichloroethane | 2.0 |
| Span 80 | 0.9 |
| Tween 80 | 1.1 |
| Water | 69.6 |

This formulation when tested as in Example 1 gave approximately similar results.

EXAMPLE 6

The formulation of Example 5 was prepared with the exception that the Isopar-K level was increased to 16% and 20% with a corresponding reduction in the water content. Both of these formulas performed essentially equivalent to the formulation of Example 5.

EXAMPLE 7

A series of formulations were prepared having the following composition:

| | |
|---|---|
| Water | Varies |
| Tetrasodium EDTA (40%) | Varies |
| Citric Acid (50%) | to pH 7.9 |
| Surfonic N-60 | 10.0 |
| Isopar K | 12.0 |
| | 100.0 |

The formulations shown in Table 2 were tested as in Example 1. The same comparative formulation as in Example 1 was also used.

TABLE 2

| Run | A | B | C | D | E | F | G | H | I[1] | Comp.[2] |
|---|---|---|---|---|---|---|---|---|---|---|
| Water | 77.71 | 77.26 | 75.05 | 72.1 | 66.2 | 60.3 | 54.4 | 48.5 | 78 | — |
| EDTA | 0.25 | 0.625 | 2.5 | 5.0 | 10.0 | 15 | 20 | 25 | — | — |
| Cotton | | | | | | | | | | |
| Used Motor Oil | 2 | 2 | 2.5 | 3 | 3 | 3 | 2.5 | 2.5 | 2 | 4 |
| Grape | 2 | 2 | 2 | 2.5 | 2.5 | 2.5 | 2.5 | 2.5 | 1 | 1 |
| Chocolate | 3 | 3 | 3 | 3 | 3 | 3 | 3 | 3 | 3 | 3.5 |
| Clay | 4 | 4 | 4 | 3.5 | 4.5 | 4.5 | 4.5 | 4.5 | 3.5 | 2.5 |
| Sebum | 3 | 3 | 3 | 3 | 3 | 3 | 3 | 3 | 3 | 2 |
| 65/35 | | | | | | | | | | |
| Used Motor Oil | 2 | 2.5 | 3.5 | 3.5 | 3.5 | 4 | 3 | 3 | 2.5 | 4.5 |
| Grape | 4 | 4 | 4 | 4.5 | 4.5 | 4.5 | 4.5 | 4.5 | 3 | 3 |
| Chocolate | 3.5 | 3.5 | 3.5 | 4 | 4 | 4 | 4 | 4 | 3 | 3 |
| Clay | 4 | 4 | 4 | 4.5 | 4.5 | 4.5 | 4.5 | 4.5 | 4 | 4.5 |
| Sebum | 4 | 4 | 4 | 4 | 3.5 | 3.5 | 3.5 | 3.5 | 4 | 4 |
| Polyester | | | | | | | | | | |
| Used Motor Oil | 2 | 2.5 | 3 | 3 | 3 | 3 | 3 | 3 | 2 | 4.5 |
| Grape | 4.5 | 4.5 | 4.5 | 5 | 5 | 5 | 5 | 5 | 4.5 | 5 |
| Clay | 3 | 3 | 4 | 4 | 4 | 4 | 3.5 | 3.5 | 2.5 | 4 |
| Sebum | 4.5 | 4.5 | 4.5 | 4.5 | 4 | 4 | 4 | 4 | 4.5 | 4.5 |

[1]Comparative Example
[2]Liquid Clorox (See Example 1)

The stain removal scores for mustard and grass for all three cloth types were identical and therefore not shown in Table 2. Also for 100% polyester the scores for chocolate were identical for all formulations.

EXAMPLE 8

The formulation as shown in Table 3 were prepared and tested using the procedure of Example 1. The stain removal results were similar to that shown in Table 1.

TABLE 3

| | A | B | C | D | E |
|---|---|---|---|---|---|
| Water | 70.1 | 70.1 | 70.1 | 70.1 | 70.1 |
| Tetrasodium EDTA (40%) | 5.0 | 5.0 | 5.0 | 5.0 | 5.0 |
| Citric Acid (50%) | 0.9 | 0.9 | 0.9 | 0.9 | 0.9 |
| Surfonic N-60 | 10 | 10 | 10 | 10 | 10 |
| Isopar K | 14 | 12 | 12 | 12 | 12 |
| Perchloroethylene | | 2 | | | |
| Methylene Chloride | | | 2 | | |
| D-Limonene | | | | 2 | |
| 1,1,1-Trichloroethane | | | | | 2 |

What I claim is:

1. A metastable prespotting laundry composition consisting essentially of;

(a) from about 0.25 to 10% by weight of a chelating agent selected from the group consisting of salts of ethylenediaminetetraacetic acid, salts of diethylenetriaminepentaacetic acid, salts of (N-hydroxyethyl)ethylenediaminetriacetic acid, salts of nitrilotriacetic acid and mixture thereof;

(b) from about 1 to 35% by weight of at least one nonionic surfactant selected from the group consisting of ethoxylated nonylphenols, ethoxylated octylphenols, ethoxylated secondary fatty alcohols, ethoxylated primary fatty alcohols, ethoxylated sorbitan fatty acid esters, sorbitan fatty acid esters and mixtures thereof, wherein the surfactant has an HLB such that the combined HLB for all surfactants present is within the range of from 9 to 13;

(c) from about 5 to 60% by weight of a solvent selected from the group consisting of isoparaffinic hydrocarbons, deodorized kerosene, mineral spirits, terpenes, chlorinated hydrocarbons, an isoparaffinic hydrocarbon mixed with less than 5% of a solvent selected from the group consisting of terpenes, chlorinated hydrocarbons, aromatics, ethers and mixtures thereof, or mixtures of any of said solvents; and (d) water wherein the composition has a pH of from 4.5 to 12.2.

2. The composition of claim 1 wherein the chelating agent is selected from the group consisting of salts of ethylenediaminetetraacetic acid, salts of diethylenetriaminepentaacetic acid, salts of (N-hydroxyethyl)ethylenediaminetriacetic acid, salts of nitrilotriacetic acid, triethanolamine, diethanolamine, monoethanolamine, and mixtures thereof.

3. The composition of claim 1 wherein the chelating agent is present in an amount of from 1.0 to 6.0% by weight.

4. The composition of claim 1 wherein the chelating agent is present in an amount of from 1.5 to 4.0% by weight.

5. The composition of claim 1 wherein the chelating agent is selected from the group consisting of salts of ethylenediaminetetraacetic acid, salts of diethylenetriaminepentaacetic acid, salts of (N-hydroxyethyl)ethylenediaminetriacetic acid, salts of nitrilotriacetic acid and mixtures thereof.

6. The composition of claim 1 wherein the chelating agent is selected from the group consisting of ethylenediaminetetraacetic acid disodium salt, ethylenediaminetetraacetic acid diammonium salt, ethylenediaminetetraacetic acid dipotassium salt, ethylenediaminetetraacetic acid tripotassium salt, ethylenediaminetetraacetic acid trisodium salt, ethylenediaminetetraacetic acid tetrasodium salt, ethylenediaminetetraacetic acid tetrapotassium salt, ethylenediaminetetraacetic acid tetrammonium salt, nitrilotriacetic acid trisodium salt, nitrilotriacetic acid tripotassium salt, and mixtures thereof.

7. The composition of claim 1 where the chelating agent is selected from the group consisting of ethylenediaminetetraacetic acid tetrasodium salt, ethylenediaminetetraacetic acid trisodium salt, ethylenediaminetetraacetic acid disodium salt, and mixtures thereof.

8. The composition of claim 1 wherein the composition includes an effective amount of an acid sufficient to adjust the pH of the composition to within the range of 4.5 to 12.2.

9. The composition of claim 1 wherein the composition has a pH within the range of from 6.5 to 8.5.

10. The composition of claim 1 wherein the composition has a pH within the range of from 7.0 to 8.0.

11. The composition of claim 1 wherein the HLB range is from 10 to 12.

12. The composition of claim 1 wherein the HLB range is from 10.5 to 11.5.

13. The composition of claim 1 wherein the surfactants are present in the about of 5.0 to 20.0% by weight.

14. The composition of claim 1 wherein the surfactants are present in the amount from 7.0 to 20.0% by weight.

15. The composition of claim 1 wherein the solvent is present in an amount of from about 5 to 30% by weight.

16. The composition of claim 1 wherein the solvent is present in an amount of from about 7 to 20% by weight.

17. The composition of claim 1 wherein the solvent is an isoparaffinic hydrocarbon.

18. The composition of claim 1 wherein the solvent is an isoparaffinic hydrocarbon mixed with less than 5% of a solvent selected from the group consisting of d-limonene, 1,1,1 trichloroethane, perchloroethylene and mixtures thereof.

19. The composition of claim 1 wherein the nonionic surfactant is selected from the group consisting of ethoxylated nonylphenols, ethoxylated octylphenols, ethoxylated secondary fatty alcohols, ethoxylated primary fatty alcohols and mixtures thereof.

20. A metastable laundry prespotting composition consisting essentially of (a) from about 1.0 to 6.0% by weight of a chelating agent selected from the group consisting of salts of ethylenediaminetetraacetic acid, salts of diethylenetriaminepentaacetic acid, salts of (N-hydroxyethyl)ethylenediaminetriacetic acid, salts of nitrilotriacetic acid and mixtures thereof;

(b) from about 5 to 20% by weight of at least one nonionic surfactant selected from the group consisting of ethoxylated nonylphenols, ethoxylated octylphenols, ethoxylated secondary fatty alcohols, ethoxylated primary fatty alcohols, ethoxylated sorbitan fatty acid esters, sorbitan fatty acid esters and mixtures thereof, wherein surfactant has an HLB such that the combined HLB for all surfactants present is within the range of from 10 to 12;

(c) from about 5 to 30% by weight of a solvent selected from the group consisting of isoparaffinic hydrocarbons, deodorized kerosene, mineral spirits, terpenes, chlorinated hydrocarbons and mixtures thereof with the provision that the terpenes and chlorinated hydrocarbons are present in an amount less than 5% by weight; and (d) water wherein the composition has a pH within the range of 6.5 to 8.5.

* * * * *